US012693068B1

(12) United States Patent
McGuire

(10) Patent No.: US 12,693,068 B1
(45) Date of Patent: Jul. 28, 2026

(54) COOLER INCLUDING A PROTECTIVE BARRIER INSERT

(71) Applicant: Drew McGuire, Grass Valley, CA (US)

(72) Inventor: Drew McGuire, Grass Valley, CA (US)

( * ) Notice: Subject to any disclaimer, the term of this patent is extended or adjusted under 35 U.S.C. 154(b) by 225 days.

(21) Appl. No.: 18/196,199

(22) Filed: May 11, 2023

Related U.S. Application Data

(60) Provisional application No. 63/341,050, filed on May 12, 2022.

(51) Int. Cl.
*F25D 25/02* (2006.01)
*F25D 3/08* (2006.01)

(52) U.S. Cl.
CPC ..... *F25D 25/02* (2013.01); *F25D 3/08* (2013.01); *F25D 2325/021* (2013.01); *F25D 2331/804* (2013.01); *F25D 2331/806* (2013.01)

(58) Field of Classification Search
CPC ..... F25D 25/00; F25D 25/02; F25D 25/021; F25D 25/024; F25D 3/00; F25D 3/06; F25D 3/08; F25D 2323/02; F25D 2323/06; F25D 2325/00; F25D 2325/021; F25D 2331/804; F25D 2331/801; F25D 2331/806
See application file for complete search history.

(56) References Cited

U.S. PATENT DOCUMENTS 4,307,581 A 12/1981 Reid
4,436,215 A * 3/1984 Kleinert ..... A47B 88/975 312/263
4,515,421 A 5/1985 Steffes
5,052,185 A 10/1991 Spahr
6,626,006 B1 9/2003 Tedder
6,726,050 B1 4/2004 Barentine et al.
8,839,965 B2 9/2014 Benneche et al.
11,242,175 B2 * 2/2022 Barfoot ..... B65D 81/3818
2004/0238543 A1 * 12/2004 Askew ..... B65D 81/3816 220/529
2008/0149662 A1 * 6/2008 Scardino ..... F25D 3/08 222/386
2009/0025417 A1 1/2009 Azzara
2009/0045204 A1 2/2009 Marganski

* cited by examiner

*Primary Examiner* — Miguel A Diaz

(74) *Attorney, Agent, or Firm* — John Rizvi; John Rizvi, P.A. - The Patent Professor®

(57) ABSTRACT

A cooler for storing items in a compartment thereof comprises at least one protective barrier insert configured to be located and fixed within the compartment in a manner that is capable of reducing the likelihood of movement of items stored within the compartment during transport and/or movement of the cooler. The cooler comprises a track system that provides multiple locking positions to selectively secure the first insert in one of multiple fixed positions corresponding to a respective one of the multiple locking positions. The insert(s) extends between the interior surfaces of a front wall, a rear wall, and a pair of side walls of the cooler when secured in each of the multiple fixed positions and thereby separates the compartment into at least a pair of multiple subcompartments corresponding to the respective one of the multiple fixed positions.

17 Claims, 8 Drawing Sheets

COOLER INCLUDING A PROTECTIVE BARRIER INSERT

CROSS-REFERENCE TO RELATED APPLICATION(S

This application claims priority to U.S. Provisional Application No. 63/341,050 filed on May 13, 2022, which is incorporated herein by reference in its entirety.

FIELD OF THE INVENTION

The present invention relates generally to coolers, and more particularly, to a cooler that includes a protective barrier insert within a compartment thereof that is capable of reducing the likelihood of movement of items stored within the compartment during transport and/or movement of the cooler.

BACKGROUND OF THE INVENTION

A cooler is a portable, insulated container typically used for temporarily maintaining food, drinks, or other perishable items stored in a compartment thereof at reduced temperatures, for example, during travel and/or outdoors. Coolers are commercially available in a wide variety of shapes and sizes, provide various insulative capabilities, and may include various secondary features (e.g., cup holders, wheels, etc.). While some actively cooled coolers exist (e.g., thermoelectric coolers), a majority of coolers are passively cooled and rely on their insulative capabilities to maintain the compartment thereof at reduced temperatures, which are initially provided by low temperature inserts such as ice, ice packs, and/or pre-cooled perishable items.

A common type of passively cooled cooler includes a six-sided container with rigid walls that in combination define a generally rectangular cuboid shape. Interior surfaces of the six walls define a compartment therebetween and one of the walls (e.g., the uppermost wall) is pivotally coupled to another of walls adjacent thereto and usable as a lid configured to selectively seal and/or provide access to the compartment. Often, the walls include rigid interior and exterior layers with an insulation layer therebetween. Generally, the interior and exterior layers are formed of rigid polymeric materials suitable for retaining the shape of the container and promoting durability. The insulation layer may include, for example, a polymeric foam material having a relatively low thermal conductivity. The interior and exterior layers are usually each formed of a single, integral body to, for example, promote insulative capabilities, provide a water-tight seal, promote ease of cleaning, and/or promote buoyancy. Some modern coolers are rotationally molded such that the resulting container does not include any seals.

Traditionally, passively cooled coolers have been partially filled with loose ice and then the items to be cooled are inserted into the ice. However, ice packs are now commonly used as a replacement for loose ice. Ice packs have an advantage of retaining their frozen elements within a container thereby avoiding loose liquid whereas loose ice eventually melts filling the cooler with water. Further, ice packs, especially ice packs that contain certain gel materials, may be capable of freezing at lower temperatures than water-based ice, thereby providing lower temperatures within the cooler and/or remaining at least partially frozen for a longer period of time.

However, ice packs may have disadvantages over loose ice in certain situations. For example, loose ice may function as a matrix providing support to the items during transport of the cooler and thereby may assist in securing the items in relatively fixed positions. In contrast, ice packs are stored within self-contained packages or containers that may not surround or otherwise assist in securing positions of the items. As such, the items within the cooler may be more likely to experience significant movement during transport of the cooler when using ice packs relative to loose ice, and such movement may result in damage of the items stored within the cooler and/or spillage of contents stored within the items.

Accordingly, there is an established need for a cooler that is capable of reducing the likelihood of movement of items stored within a compartment thereof during transport and/or movement of the cooler itself.

SUMMARY OF THE INVENTION

The present invention is directed to a convenient cooler for storing items in a compartment thereof comprises a body that includes a front wall, a rear wall opposite the front wall, a pair of side walls extending between and secured to end portions of the front wall and the rear wall, a bottom wall extending between and secured to bottom portions of the front wall, the rear wall, and the pair of side walls, and a top wall extending between top portions of the front wall, the rear wall, and the pair of side walls and secured to the top portion of at least one of the front wall, the rear wall, and the pair of side walls. Interior surfaces of the front wall, the rear wall, the pair of side walls, the bottom wall, and the top wall define the compartment therebetween. The top wall is configured to function as a lid to selectively transition between an open configuration that provides access to the compartment and a closed configuration that entirely encloses the compartment. The cooler includes a first insert configured to be received within the compartment and secured in a first fixed position within the compartment such that the first insert extends between the interior surfaces of the front wall, the rear wall, and the pair of side walls and thereby separates the compartment into at least first and second subcompartments.

In a first implementation of the invention, a cooler for storing items in a compartment thereof comprises a body that includes a front wall, a rear wall opposite the front wall, a pair of side walls extending between and secured to end portions of the front wall and the rear wall, a bottom wall extending between and secured to bottom portions of the front wall, the rear wall, and the pair of side walls, and a top wall extending between top portions of the front wall, the rear wall, and the pair of side walls and secured to the top portion of at least one of the front wall, the rear wall, and the pair of side walls. Interior surfaces of the front wall, the rear wall, the pair of side walls, the bottom wall, and the top wall define the compartment therebetween. The top wall is configured to function as a lid to selectively transition between an open configuration that provides access to the compartment and a closed configuration that entirely encloses the compartment. The cooler includes a first insert configured to be received within the compartment and secured in a first fixed position within the compartment such that the first insert extends between the interior surfaces of the front wall, the rear wall, and the pair of side walls and thereby separates the compartment into at least first and second subcompartments.

In a second aspect, the cooler may include a track system within the compartment that is configured to interface with the first insert to selectively secure the first insert in the fixed position.

In another aspect, the track system may be configured to interface with the first insert to selectively secure the first insert in a second fixed position such that the first insert extends between the interior surfaces of the front wall, the rear wall, and the pair of side walls and thereby separates the compartment into at least third and fourth subcompartments.

In another aspect, the track system may provide multiple locking positions within the compartment each configured to interface with the first insert to selectively secure the first insert in one of multiple fixed positions corresponding to a respective one of the multiple locking positions, wherein the first insert extends between the interior surfaces of the front wall, the rear wall, and the pair of side walls when secured in each of the multiple fixed positions and thereby separates the compartment into at least a pair of multiple subcompartments corresponding to the respective one of the multiple fixed positions.

In another aspect, the track system may include at least first and second rails embedded within or fixed to opposing positions in the pair of side walls, the first and second rails each including a plurality of locking positions each associated with a pair of oppositely disposed recesses in the first and second rails, the first insert including locking members configured to extend from ends of the first insert and engage with the recesses to be secured in one of a plurality of fixed positions corresponding to the plurality of locking positions, and a release mechanism configured to retract the locking members to disengage the recesses and thereby release the first insert from the one of the plurality of fixed positions.

In another aspect, the first insert may include a handle protruding from a face thereof and the release mechanism may be a component of the handle.

In another aspect, the cooler may include a second insert configured to be received within the compartment while the first insert is secured in the first fixed position therein and secured in a second fixed position within the compartment such that the second insert extends between the interior surfaces of the front wall, the rear wall, and the pair of side walls and thereby separates at least the second subcompartment into at least third and fourth subcompartments.

In another aspect, the first insert may be configured to releasably engage the interior surfaces of the top wall to be secured thereto.

In another aspect, the interior surfaces of the top wall may include a lower recess configured to receive and secure the first insert therein such that exposed surfaces of the first insert are flush with exposed surfaces of the top wall adjacent to the recess thereof.

In another aspect, the first insert may be configured to releasably engage exterior surfaces of the top wall to be secured thereto, the first insert comprising a working surface configured for use as a preparation station, the working surface being exposed when the first insert is engaged with the exterior surfaces of the top wall.

In another aspect, the exterior surfaces of the top wall may include an upper recess configured to receive therein at least a portion of the first insert such that the first insert is restricted from lateral movement relative to the top wall.

In another aspect, the upper recess of the top wall may be configured to receive therein the handle of the first insert.

In another aspect, the cooler may include one or more pouches to store fluids, a drain plug attached to the cooler, one or more dispensing ports; and a dispensing element configured to be removably attached to one of the one or more dispensing ports. The plurality of pouches may be disposed inside the body. A first portion of the drain plug may protrude inside the cooler and a second portion of the drain plug may protrude out of the cooler. The one or more pouches may be attached to the first portion of the drain plug. The one or more dispensing ports may be attached to the second portion of the drain plug.

In another aspect, the cooler may include a plurality of feet removably attached to the exterior surface of the bottom wall.

In another aspect, the cooler may include a wheel system removably attached to the exterior surface of the bottom wall.

In a second implement of the invention, a method for storing items comprises providing a cooler comprising a body that includes a front wall, a rear wall opposite the front wall, a pair of side walls extending between and secured to end portions of the front wall and the rear wall, a bottom wall extending between and secured to bottom portions of the front wall, the rear wall, and the pair of side walls, and a top wall extending between top portions of the front wall, the rear wall, and the pair of side walls and secured to the top portion of at least one of the front wall, the rear wall, and the pair of side walls, wherein interior surfaces of the front wall, the rear wall, the pair of side walls, the bottom wall, and the top wall define a compartment therebetween. The method includes transitioning the top wall from a closed configuration that entirely encloses the compartment to an open configuration that provides access to the compartment, locating at least a first item within the compartment, inserting a first insert within the compartment over the first item, and securing the first insert in a first fixed position within the compartment such that the first insert extends between the interior surfaces of the front wall, the rear wall, and the pair of side walls and thereby separates the compartment into at least first and second subcompartments, wherein at least the first item is within the first subcompartment.

In another aspect, the method may include securing the first insert in the fixed position by interfacing the first insert with a track system within the compartment.

In another aspect, the method may include securing the first insert in a second fixed position by interfacing the first insert with the track system such that the first insert extends between the interior surfaces of the front wall, the rear wall, and the pair of side walls and thereby separates the compartment into at least third and fourth subcompartments.

In another aspect, the track system may provide multiple locking positions within the compartment, the method may include securing the first insert in one of multiple fixed positions corresponding to a respective one of the multiple locking positions, wherein the first insert extends between the interior surfaces of the front wall, the rear wall, and the pair of side walls when secured in each of the multiple fixed positions and thereby separates the compartment into at least a pair of multiple subcompartments corresponding to the respective one of the multiple fixed positions.

In another aspect, the track system may include at least first and second rails embedded within or fixed to opposing positions in the pair of side walls, the first and second rails each including a plurality of locking positions each associated with a pair of oppositely disposed recesses in the first and second rails, the method may include extending locking members from ends of the first insert to engage with the recesses and thereby secure the first insert in one of a plurality of fixed positions corresponding to the plurality of locking positions, and then retracting the locking members with a release mechanism to disengage the locking members from the recesses and thereby release the first insert from the one of the plurality of fixed positions.

In another aspect, the method may include grasping a handle protruding from a face of the first insert and interacting with the release mechanism thereon.

In another aspect, the method may include inserting a second insert within the compartment while the first insert is secured in the first fixed position therein and securing the second insert in a second fixed position within the compartment such that the second insert extends between the interior surfaces of the front wall, the rear wall, and the pair of side walls and thereby separates at least the second subcompartment into at least third and fourth subcompartments.

In another aspect, the method may include securing the first insert to the interior surfaces of the top wall.

In another aspect, the method may include inserting the first insert into a lower recess of the interior surfaces of the top wall and securing the first insert therein such that exposed surfaces of the first insert are flush with exposed surfaces of the top wall adjacent to the recess thereof.

In another aspect, the method may include using a working surface of the first insert as a preparation station.

In another aspect, the method may include inserting at least a portion of the first insert into an upper recess of exterior surfaces of the top wall such that the first insert is restricted from lateral movement relative to the top wall, wherein the working surface of the first insert is exposed.

In another aspect, the method may include locating the handle of the first insert within the upper recess of the top wall.

In a third implementation of the invention, a cooler for storing items in a compartment thereof comprises a body that includes a front wall, a rear wall opposite the front wall, a pair of side walls extending between and secured to end portions of the front wall and the rear wall, a bottom wall extending between and secured to bottom portions of the front wall, the rear wall, and the pair of side walls, and a top wall extending between top portions of the front wall, the rear wall, and the pair of side walls and secured to the top portion of at least one of the front wall, the rear wall, and the pair of side walls. Interior surfaces of the front wall, the rear wall, the pair of side walls, the bottom wall, and the top wall define the compartment therebetween. The top wall is configured to function as a lid to selectively transition between an open configuration that provides access to the compartment and a closed configuration that entirely encloses the compartment. The cooler further includes a first insert configured to be received within the compartment and releasably secured in one of a plurality of fixed positions within the compartment such that the first insert extends between the interior surfaces of the front wall, the rear wall, and the pair of side walls and thereby separates the compartment into at least first and second subcompartments. The cooler includes a track system, located within the compartment, and comprising at least first and second rails embedded within or fixed to opposing positions in the pair of side walls, the first and second rails each comprising a plurality of locking positions each associated with a pair of oppositely disposed recesses in the first and second rails, the first insert comprising locking members configured to extend from ends of the first insert and engage with the recesses to be secured in the one of the plurality of fixed positions corresponding to the plurality of locking positions, and a release mechanism configured to retract the locking members to disengage the recesses and thereby release the first insert from the one of the plurality of fixed positions.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a convenient and economical cooler that includes at least one protective barrier insert configured to be located and fixed within a compartment of the cooler in a manner that is capable of reducing the likelihood of movement of items stored within the compartment during transport and/or movement of the cooler. The insert(s) may assist in securing the items stored in the compartment in relatively fixed positions, thereby reducing the likelihood of significant movement of the items during transport of the cooler that may result in damage of the items and/or spillage of contents stored within the items.

Figure 1:
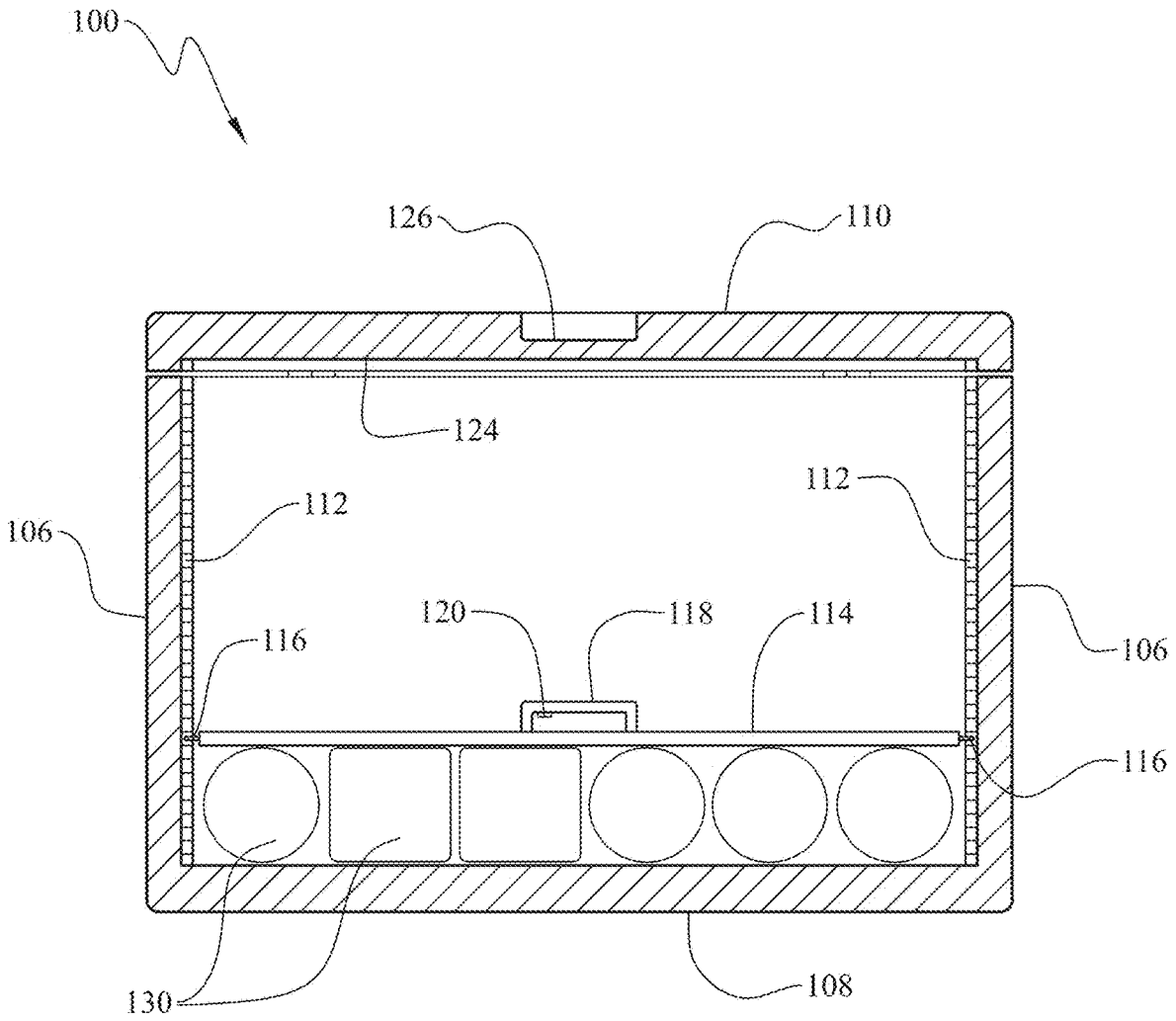
FIG. 1 presents a cross-sectional side view of a cooler having a protective barrier insert in a first position within a compartment thereof in accordance with a first embodiment of the present invention.
Figure 2:
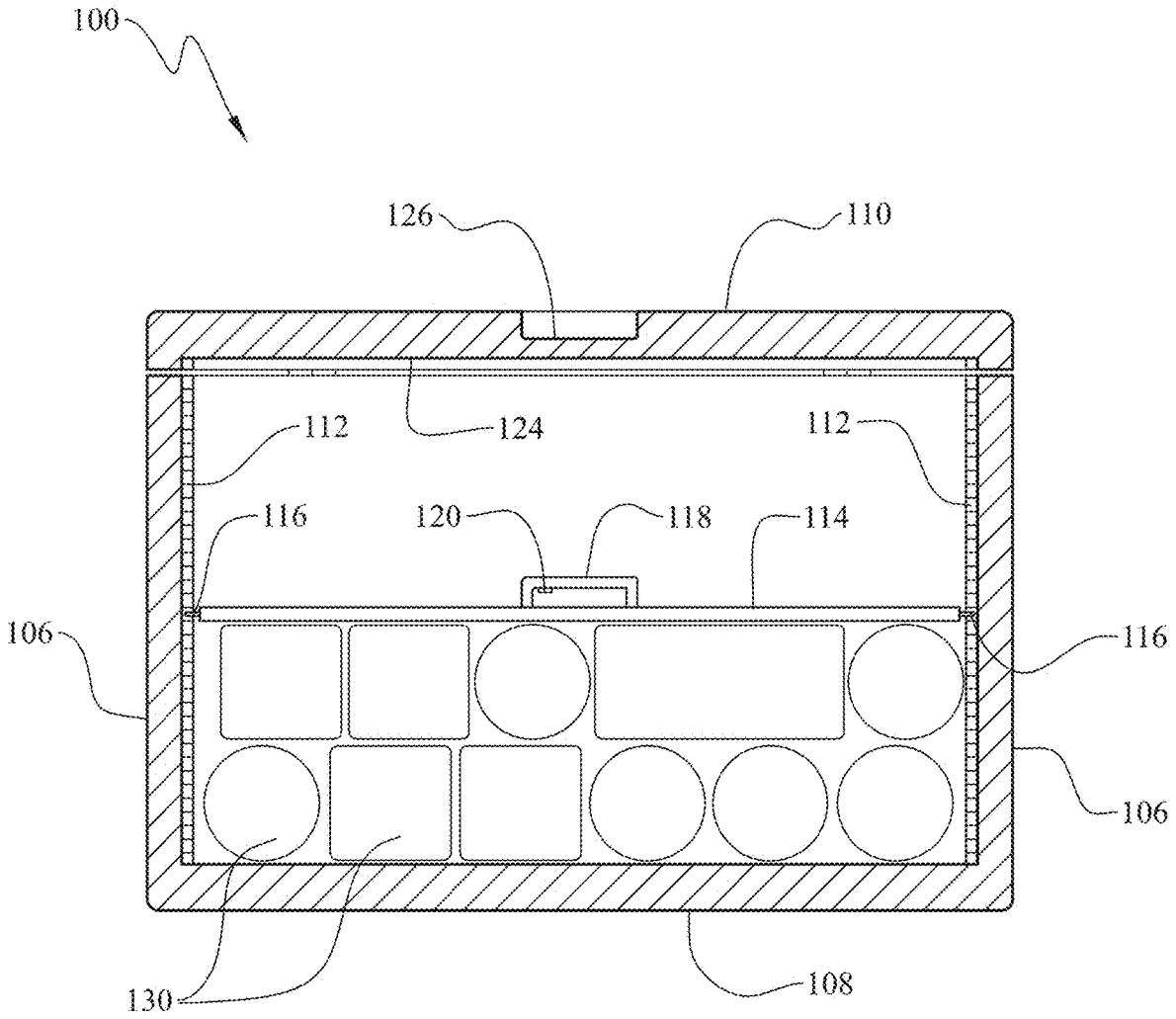
FIG. 2 presents a cross-sectional side view of the cooler of FIG. 1 having the insert in a second position within the compartment thereof.
Figure 3:
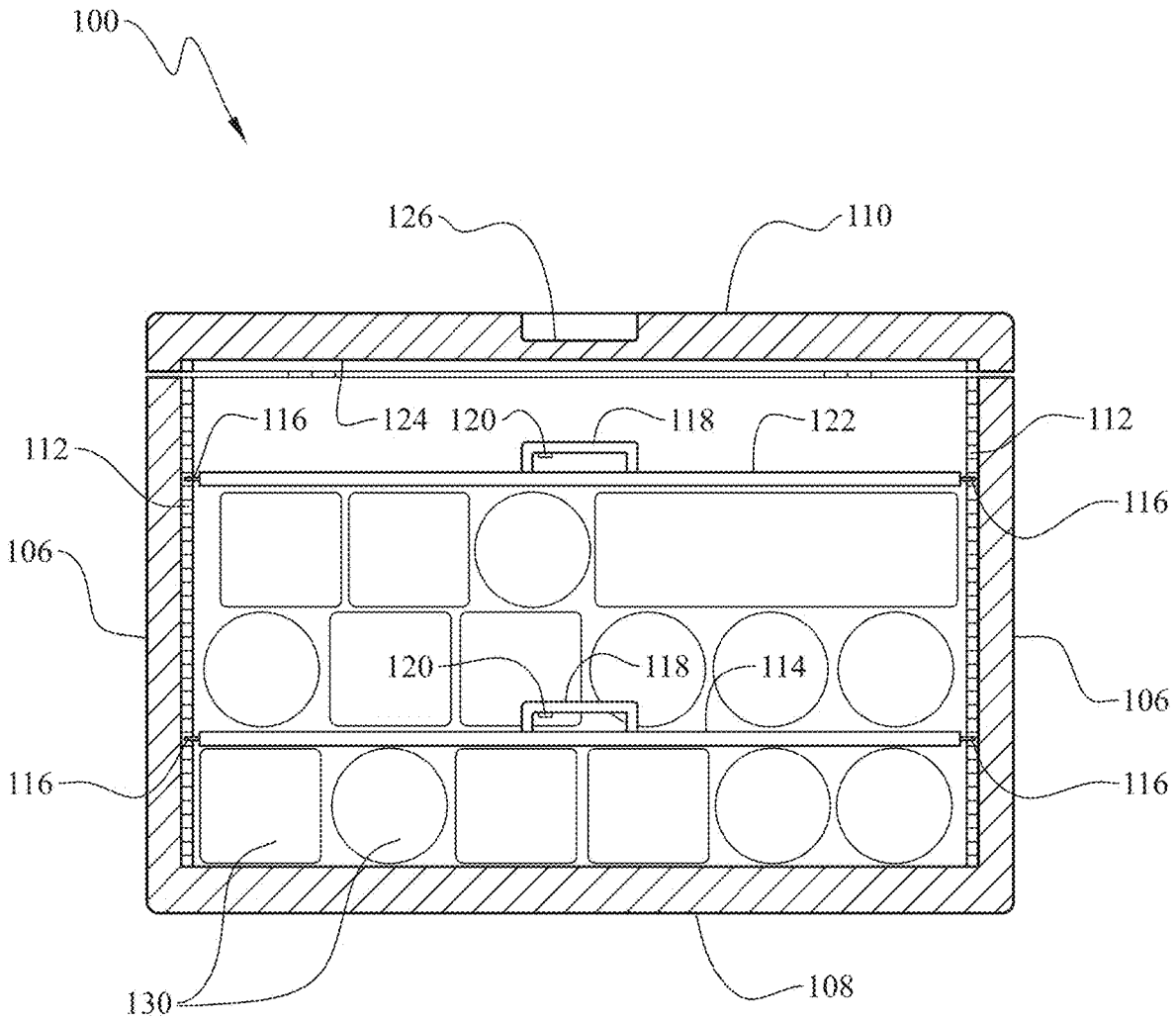
FIG. 3 presents a cross-sectional side view of the cooler of FIGS. 1 and 2 having a first insert in a first position and a second insert in a second position within the compartment of the cooler.
Figure 4:
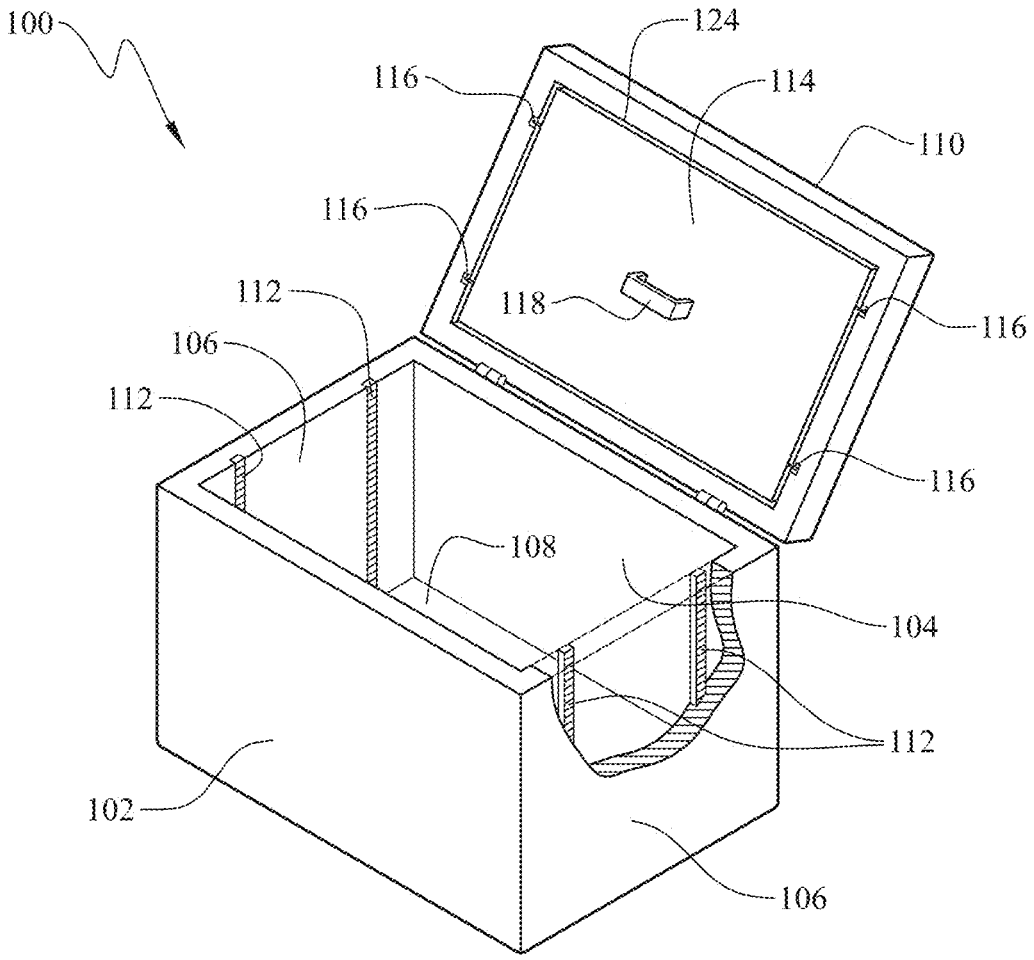
FIG. 4 presents a perspective view of the cooler of FIGS. 1-3 with a partial cutaway section in a sidewall thereof and a lid thereof in an open configuration.
Figure 5:
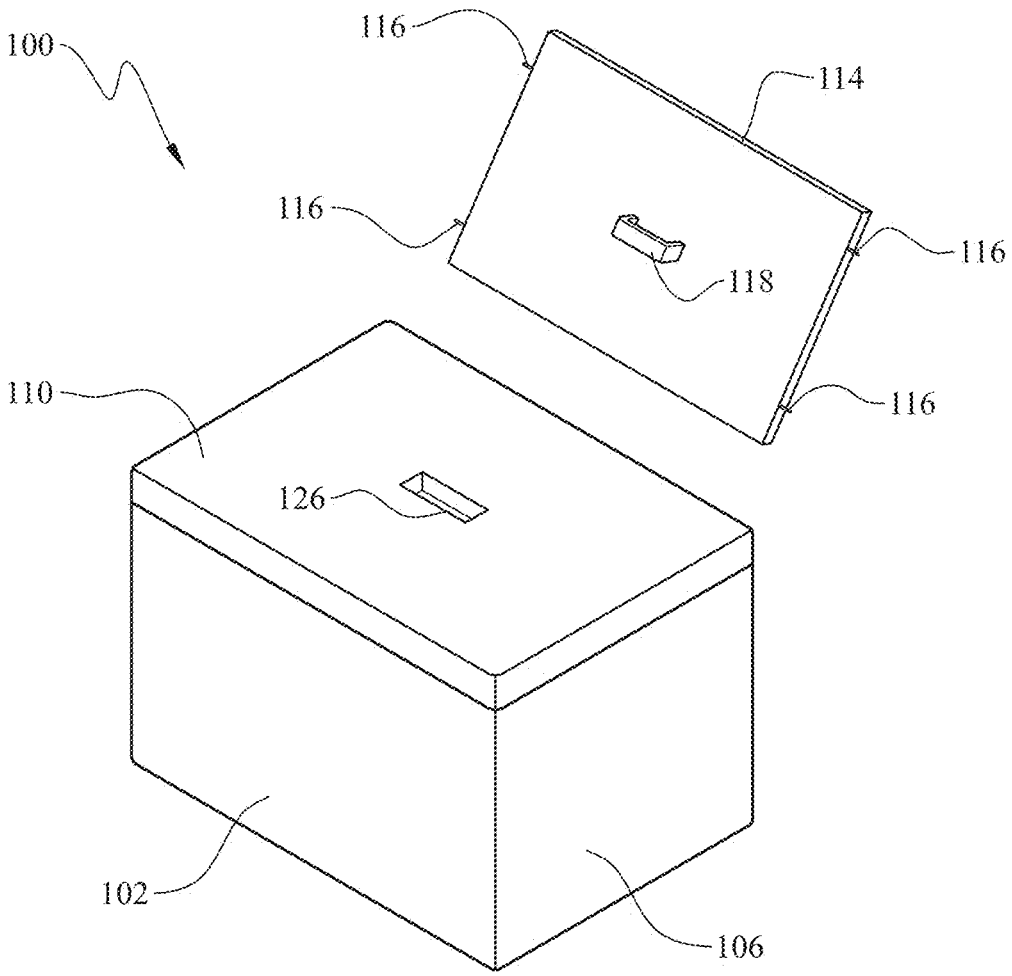
FIG. 5 presents a perspective view of the cooler of FIGS. 1-4 with the lid thereof in a closed configuration.
Figure 6:
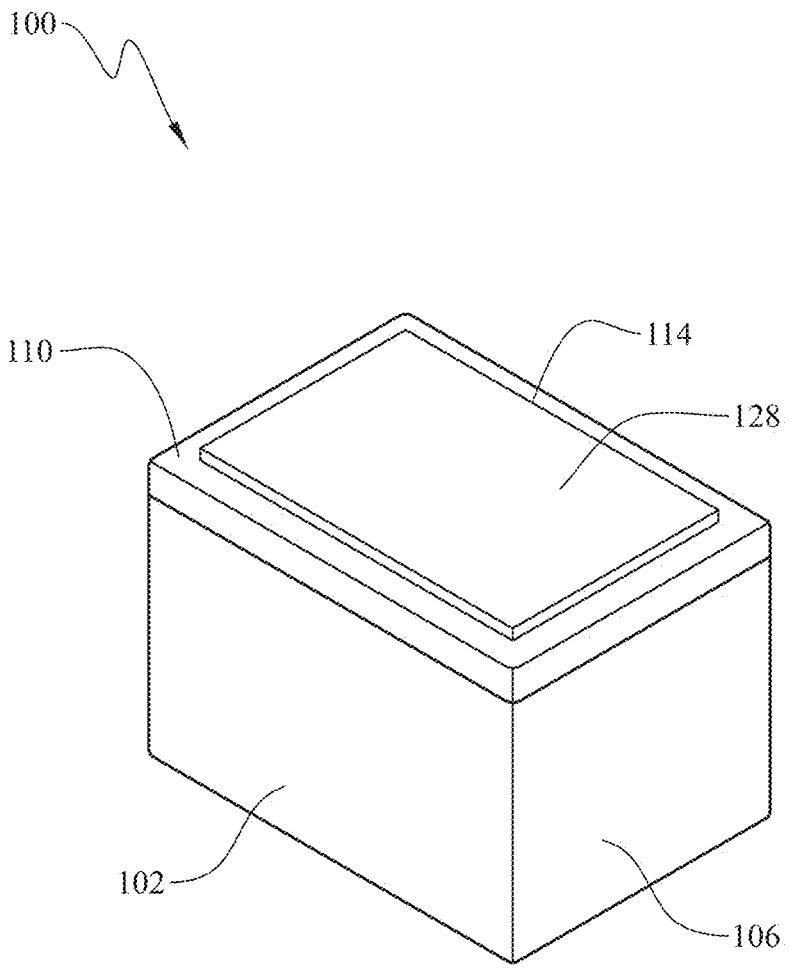
FIG. 6 presents a perspective view of the cooler of FIGS. 1-5 with the insert thereof coupled with the lid thereof to define a preparation station.

Referring initially to FIGS. 1 through 3, a first embodiment of the cooler is presented, referred to hereinafter as the cooler 100, that is suitable for storing items in a compartment thereof. The cooler 100 comprises a body having a front wall 102, a rear wall 104 opposite the front wall 102, a pair of side walls 106 extending between and secured to end portions of the front wall 102 and the rear wall 104, a bottom wall 108 extending between and secured to bottom portions of the front wall 102, the rear wall 104, and the pair of side walls 106, and a top wall 110 extending between top portions of the front wall 102, the rear wall 104, and the pair of side walls 106 and secured to the top portion of at least one of the front wall 102, the rear wall 104, and the pair of side walls 106. Interior surfaces of the front wall 102, the rear wall 104, the pair of side walls 106, the bottom wall 108, and the top wall 110 define the compartment therebetween. The top wall 110 is configured to function as a lid to selectively transition between an open configuration (e.g., FIG. 4) that provides access to the compartment and a closed configuration (e.g., FIGS. 1-3, 5, and 6) that entirely encloses the compartment. For example, the top wall 110 may be secured to the top portion of the rear wall 104 with hinges, as presented in FIG. 4.

The cooler 100 includes at least a first insert 114 that is configured to be received within the compartment and secured therein to separate the compartments into subcompartments. To this end, the cooler 100 includes a track system having a first and second rails 112 embedded within a first of the side walls 106 and oppositely disposed third and fourth rails 112 embedded within a second of the side walls 106. The first, second, third, and fourth rails 112 each include a plurality of recesses therein that are aligned with corresponding recesses of the other rails 112. That is, each of the recesses in each of the first, second, third, and fourth rails 112 are within one of multiple geometric planes with recesses in each of the other rails 112 wherein each of the geometric planes are parallel with the interior surfaces of the bottom wall 108. For convenience, each of these geometric planes that comprise recesses of the first, second, third, and fourth rails 112 are referred to herein as locking positions that represent or correspond to a fixed position in which the first insert 114 may be secured.

The first insert 114 includes locking members 116 that are configured to extend and retract from ends of the first insert 114. In this manner, the locking members 116 may selectively engage with the recesses of the first, second, third, and fourth rails 112 to be secured in one of a plurality of fixed positions corresponding to the plurality of locking positions. The first insert 114 includes a release mechanism 120 on a handle 118 thereof operable to retract the locking members 116 such that the locking members 116 disengage from the recesses and thereby release the first insert 114 from the one of the plurality of fixed positions. As such, the first insert 114 and the track system are configured to interact in a manner that allows the first insert 114 to be selectively secured in various fixed positions within the cooler 100 depending on the desired sizes of the resulting subcompartments.

As nonlimiting examples, FIGS. 1 and 2 present the first insert 114 in first and second fixed positions, respectively. In the first fixed position of FIG. 1, items 130 are stored in a single row below the first insert 114. In the second fixed position of FIG. 2, stacked items 130 are stored in two rows below the first insert 114. In both arrangements, the first insert 114 may function as a barrier limiting the possible movement of the items 130 therebelow during movement of the cooler 100.

Since the track system provides a plurality of locking positions, the cooler 100 may further include one or more additional inserts that, depending on the available space, may be secured within the compartment simultaneously to separate the compartment into multiple subcompartments. The additional inserts may be identical to and/or function in substantially the same manner as previously described for the first insert 114. As a nonlimiting example, FIG. 3 presents the first insert 114 in the first fixed position and a second insert 122 in another fixed position thereabove. Items 130 are stored in a single row below the first insert 114 and stacked items 130 are stored in two rows on top of the first insert 114 and below the second insert 122. As such, the items 130 below the first insert 114 and the items 130 between the first insert 114 and the second insert 122 may be held in place in the event of movement of the cooler 100.

In this embodiment, the interior surfaces of the top wall 110 include a lower recess 124 configured to receive and secure the first insert 114 therein, for example, for storage of the first insert 114 when not in use. Portions of the interior surfaces that define ends of the lower recess 124 may include recesses similar to those of the track system, that is, configured to receive therein the locking members 116 of the top wall 110 for releasably securing the first insert 114 within the lower recess 124. Optionally, the lower recess 124 and/or the first insert 114 may be configured such that exposed surfaces of the first insert 114 (other than the handle 118) are flush with exposed surfaces of the top wall 110 adjacent to the recess thereof when the first insert 114 is secured within the lower recess 124, as presented in FIG. 4.

The exterior surfaces of the top wall 110 include an upper recess 126 configured to receive therein at least a portion of the first insert 114 (e.g., the handle 118) such that the first insert 114 is restricted from lateral movement relative to the top wall 110 while resting thereon. Further, the first insert 114 may include a working surface 128 (e.g., on a bottom face thereof) configured for use as a preparation station. Since the working surface 128 is exposed when the first insert 114 is engaged with the exterior surfaces of the top wall 110, the working surface 128 may be used for preparing items thereon while the first insert 114 is fixed, at least laterally, relative to the cooler 100.

Figure 7:
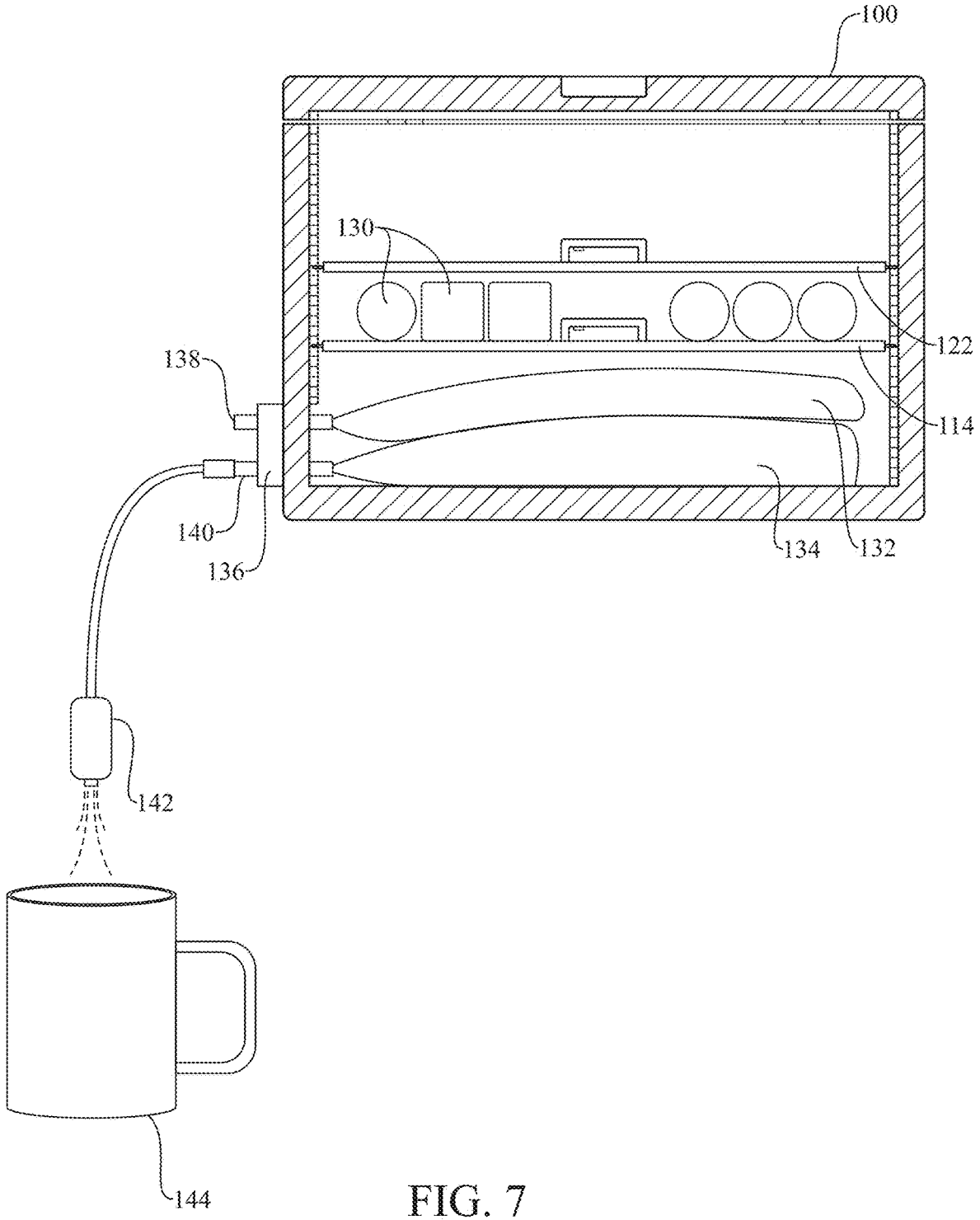
FIG. 7 presents a perspective view of the cooler comprising one or more pouches to store fluids.

With reference to FIG. 7, the cooler 100 may comprise one or more pouches 132, 134 to carry fluids or liquids. A drain plug 136 may be attached on at least one of the front wall 102, the rear wall 104, and the pair of side walls 106, such that a rear portion of the drain plug 136 may protrude inside the interior of the cooler 100 and a front portion of the drain plug 136 may protrude outside the cooler 100. Typically, the drain plug is provided in the coolers to drain unwanted fluid (e.g., water from the melted ice) from the coolers. The drain plug 136 is adapted to have one or more dispensing ports 138, 140 to dispense off the fluids stored in the one or more pouches 132, 134. The drain plug 136 may also have a drain port (not shown in the drawings) to get rid of undesired fluid (e.g., water from the melted ice) from the body of the cooler 100.

As may be seen in FIG. 7, the rear portion of the drain plug 136 may have one or more rear-side openings. The one or more pouches 132, 134 may be attached to the one or more rear-side openings. The front portion of the drain plug 136 may have one or more front-side openings. The one or more rear-side openings may be connected to the one or more front-side openings through one or more holes such that the fluid from the one or more pouches 132, 134 may travel to the one or more front-side openings.

The one or more front-side openings of the drain plug 136 may be attached to the one or more dispensing ports 138, 140 on the exterior of the cooler 100. A dispensing element 142, for example, a pump, may be removably attached to at least one of the dispensing ports 138, 140. When the dispensing element 142 is pressed or activated, it forces the fluid from a pouch inside the cooler out through the dispensing element through rear-side opening and corresponding front-side opening to which the dispensing element 142 is attached. The dispensed fluid may be collected in a container 144.

In an embodiment, the dispensing element 142 may be a mechanical dispenser that allows manual control of the flow of fluid from the pouch by squeezing, pressing, or manipulating the dispenser. In some embodiments, the dispensing element 142 may be gravity-fed dispensers, metering pumps, automated dispensers, electronic dispensers, and the like. For example, as shown in FIG. 7, the dispensing element 142 may be attached to the dispensing port 140, which is attached to the pouch 134 through the drain plug 136. When the dispensing element 142 is pressed or activated, fluid in the pouch 134 is forced to travel out of the pouch 134 via the dispensing element 142 and may be collected in the container 144. Similarly, the dispensing element 142 may be attached to the dispensing port 138, which is attached to the pouch 132 through the drain plug 136. When the dispensing element 142 is pressed or activated, fluid in the pouch 132 is forced to travel out of the pouch 132 via the dispensing element 142 and may be collected in the container 144.

As may be seen in FIG. 7, the pouches 132, 134 are provided in one of the subcompartments within the cooler defined by the first insert 114 and the second insert 122, whereas in other of the subcompartments items 130 may be stored. However, it is contemplated that in some embodiments, the cooler 100 may comprise a single insert (e.g., first insert 114), and the pouches 132, 134 may be provided in one of the compartments defined by the first insert 114. Further, it is contemplated that each of the pouches 132 and 134 may be provided in a different subcompartment within the cooler 100, the subcompartments being defined by a plurality of inserts.

Figure 8:
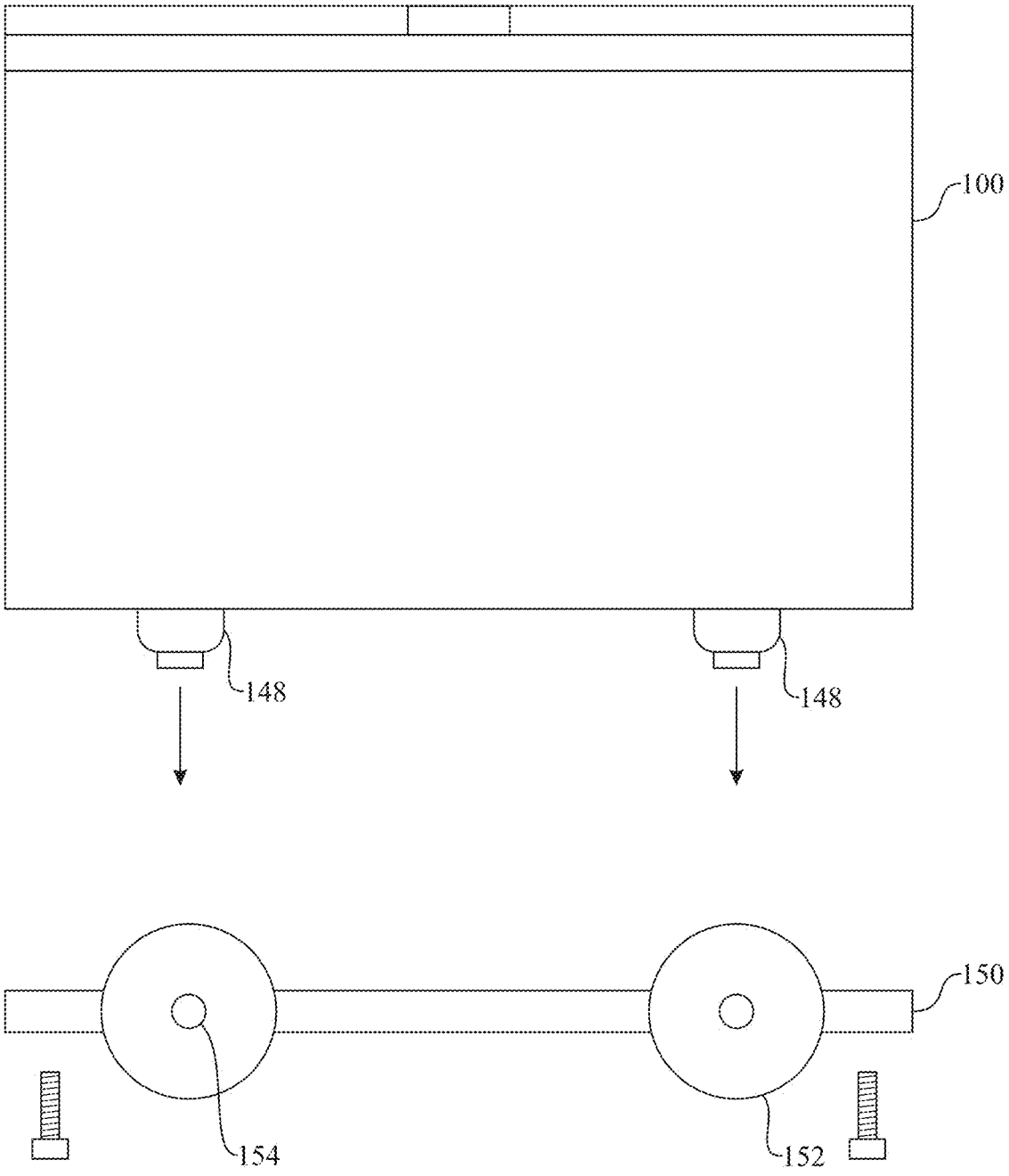
FIG. 8 presents a perspective view of the cooler with removable feet and/or a removable wheel system.

With reference to FIG. 8, the cooler 100 may comprise a plurality of feet 148 attached on the exterior surface of the bottom wall 108 of the cooler 100. The plurality of feet 148 may enable the cooler 100 to rest onto the surface on which the cooler 100 may be placed. In some embodiments, the plurality of feet 148 may be removably attached to the exterior surface of the bottom wall 108 of the cooler 100. The plurality of feet 148 may comprise sliders which are smooth pads which reduce friction between the floor or surface on which the cooler 100 may be placed and the plurality of feet 148 for sliding the cooler 100 on the surface. The sliders of the feet 148 may enable the cooler 100 to easily slide when a sliding force is acted upon the cooler. In some embodiments, the plurality of feet 148 may comprise traction elements to increase friction between the floor or surface on which the cooler 100 may be placed and the plurality of feet 148 for stabilizing cooler 100 on the surface.

Further, as can be seen in FIG. 8, the cooler 100 may comprise a wheel system 150. The wheel system 150 may be removably attached to the exterior surface of the bottom wall 108 of the cooler 100. The wheel system 150 may comprise a plurality of wheels 152. In an embodiment, the plurality of wheels 152 may be attached to a base of the wheel system 150 using bolts and nuts attached at hub 154 of each of the wheels. When the wheel system 150 is attached to the cooler 100, the plurality of wheels 152 may be rolled, thus enabling the cooler 100 to be moved.

In an embodiment, the wheel system 150 may be adapted such that the wheel system 150 is attached to the plurality of feet 148 when the plurality of feet 148 is attached to the cooler 100. In other embodiments, the wheel system 150 may be attached to cooler 100 directly, when the plurality of feet 148 is not attached to the cooler 100.

The cooler 100 provides for a method for storing items that includes opening the lid of the cooler 100, that is, transitioning the top wall 110 from the closed configuration that entirely encloses the compartment to the open configuration that provides access to the compartment. Once the compartment is accessible, the method includes locating at least a first item within the compartment, inserting the first insert 114 within the compartment over the first item, and then securing the first insert 114 in the first fixed position within the compartment such that the first insert 114 covers at least the first item is within the first subcompartment. This may be accomplished by grasping the handle 118 of the first insert 114 and operating the release mechanism 120 thereon such that the locking members 116 of the first insert 114 engage the track system.

The method may further include inserting one or more additional inserts within the compartment while the first insert 114 is secured in the first fixed position therein and securing the additional inserts in additional fixed position within the compartment. Items may be stored between and/or on any of the inserts within the compartment.

The method may include inserting the first insert 114 into the lower recess 124 of the interior surfaces of the top wall 110 and securing the first insert 114 therein such that exposed surfaces of the first insert 114 are flush with exposed surfaces of the top wall 110 adjacent to the recess thereof.

The method may include using the working surface 128 of the first insert 114 as a preparation station. Optionally, the method may include inserting at least a portion of the first insert 114 (e.g., the handle 118) into the upper recess 126 of exterior surfaces of the top wall 110 such that the first insert 114 is restricted from lateral movement relative to the top wall 110.

Alternative embodiments are contemplated in addition to the embodiments(s) shown and/or described herein. For example, the insert(s) may have various shapes, including shapes other than planar. As a specific example, the first insert 114 could include additional panels protracting therefrom such that when the first insert 114 is secured in the first fixed position, the first insert 114 separates the compartment into more than two subcompartments. In some examples, the insert(s) may be fixed within the compartment in orientations other than horizontal (i.e., parallel to interior surfaces of the bottom wall 108). As an example, the first insert 114 may be fixed within the compartment in a vertical orientation (i.e., parallel to interior surfaces of the side walls 106).

The cooler 100 and its components may be formed of various materials including certain polymeric, metallic, ceramic, and composite materials. Preferably, at least the front, rear, side, bottom, and top walls 102, 104, 106, 108, 110 are formed of one or more materials to have structures that have insulative properties suitable for maintaining an environment with the compartment at reduce or elevated temperatures relative to ambient temperatures exterior to the cooler 100 for an extended period of time. In some embodiments, the cooler 100 and/or its components may be formed of materials similar to those used for conventional coolers currently commercially available, including coolers formed via rotational molding techniques.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents

What is claimed is:

1. A cooler for storing items in a compartment thereof, the cooler comprising:

a body that includes a front wall, a rear wall opposite the front wall, a pair of side walls extending between and secured to end portions of the front wall and the rear wall, a bottom wall extending between and secured to bottom portions of the front wall, the rear wall, and the pair of side walls, and a top wall extending between top portions of the front wall, the rear wall, and the pair of side walls and secured to the top portion of at least one of the front wall, the rear wall, and the pair of side walls, wherein interior surfaces of the front wall, the rear wall, the pair of side walls, the bottom wall, and the top wall define the compartment therebetween, wherein the top wall is configured to function as a lid to selectively transition between an open configuration that provides access to the compartment and a closed configuration that entirely encloses the compartment;

a first insert configured to be received within the compartment and releasably secured in a first fixed position within the compartment such that the first insert extends between the interior surfaces of the front wall, the rear wall, and the pair of side walls and thereby separates the compartment into at least first and second subcompartments; and a track system within the compartment that is configured to interface at least with the first insert to selectively secure the first insert in at least the first fixed position, wherein the track system comprises at least first and second rails embedded within or fixed to opposing positions in the pair of side walls, the first and second rails each including a plurality of locking positions each associated with a pair of oppositely disposed recesses in the first and second rails, the first insert comprising locking members configured to extend from ends of the first insert and engage with the recesses to be secured in one of a plurality of fixed positions corresponding to the plurality of locking positions, and a release mechanism configured to retract the locking members to disengage the recesses and thereby release the first insert from the one of the plurality of fixed positions.

2. The cooler of claim 1, wherein the first insert extends between the interior surfaces of the front wall, the rear wall, and the pair of side walls when secured in each of the multiple fixed positions and thereby separates the compartment into at least a pair of multiple subcompartments corresponding to the respective one of the multiple fixed positions.

3. The cooler of claim 1, wherein the first insert comprises a handle protruding from a face thereof, and wherein the release mechanism is a component of the handle.

4. The cooler of claim 1, further comprising a second insert configured to be received within the compartment while the first insert is secured in the first fixed position therein and secured in a second fixed position within the compartment such that the second insert extends between the interior surfaces of the front wall, the rear wall, and the pair of side walls and thereby separates at least the second subcompartment into at least third and fourth subcompartments.

5. The cooler of claim 1, wherein the first insert is configured to releasably engage the interior surfaces of the top wall to be secured thereto.

6. The cooler of claim 1, wherein the interior surfaces of the top wall comprise a lower recess configured to receive and secure the first insert therein such that exposed surfaces of the first insert are flush with exposed surfaces of the top wall adjacent to the lower recess thereof.

7. The cooler of claim 1, wherein the first insert is configured to releasably engage exterior surfaces of the top wall to be secured thereto, the first insert comprising a working surface configured for use as a preparation station, the working surface being exposed when the first insert is engaged with the exterior surfaces of the top wall.

8. The cooler of claim 7, wherein the exterior surfaces of the top wall comprise an upper recess configured to receive therein at least a portion of the first insert such that the first insert is restricted from lateral movement relative to the top wall, and wherein the upper recess of the top wall is configured to receive a handle of the first insert therein.

9. The cooler of claim 1, further comprising:

one or more pouches to store fluids, the one or more pouches being disposed inside the body;

a drain plug attached to the cooler, a first portion of the drain plug protruding inside the cooler and a second portion of the drain plug protruding out of the cooler, the one or more pouches attached to the first portion of the drain plug;

one or more dispensing ports attached to the second portion of the drain plug; and a dispensing element configured to be removably attached to one of the one or more dispensing ports.

10. The cooler of claim 1, further comprising a plurality of feet removably attached to an exterior surface of the bottom wall.

11. The cooler of claim 1, further comprising a wheel system removably attached to an exterior surface of the bottom wall.

12. A method for storing items, comprising:

providing a cooler comprising a body that includes a front wall, a rear wall opposite the front wall, a pair of side walls extending between and secured to end portions of the front wall and the rear wall, a bottom wall extending between and secured to bottom portions of the front wall, the rear wall, and the pair of side walls, and a top wall extending between top portions of the front wall, the rear wall, and the pair of side walls and secured to the top portion of at least one of the front wall, the rear wall, and the pair of side walls, wherein interior surfaces of the front wall, the rear wall, the pair of side walls, the bottom wall, and the top wall define a compartment therebetween, the cooler further comprising one or more pouches to store fluids, the one or more pouches being disposed inside the body, a drain plug attached to the cooler, a first portion of the drain plug protruding inside the cooler and a second portion of the drain plug protruding out of the cooler, the one or more pouches attached to the first portion of the drain plug, one or more dispensing ports attached to the second portion of the drain plug; and a dispensing element configured to be removably attached to one of the one or more dispensing ports;

transitioning the top wall from a closed configuration that entirely encloses the compartment to an open configuration that provides access to the compartment;

locating at least a first item within the compartment;

inserting a first insert within the compartment over the first item; and securing the first insert in a first fixed position within the compartment such that the first insert extends between the interior surfaces of the front wall, the rear wall, and the pair of side walls and thereby separates the compartment into at least first and second subcompartments, wherein at least the first item is within the first subcompartment.

13. The method of claim 12, further comprising securing the first insert in the first fixed position by interfacing the first insert with a track system within the compartment.

14. The method of claim 13, further comprising securing a second insert in a second fixed position, while the first insert is secured in the first fixed position within the compartment, by interfacing the second insert with the track system such that the second insert extends between the interior surfaces of the front wall, the rear wall, and the pair of side walls and thereby separates at least the second subcompartment into at least third and fourth subcompartments.

15. A cooler for storing items in a compartment thereof, the cooler comprising:

a body that includes a front wall, a rear wall opposite the front wall, a pair of side walls extending between and secured to end portions of the front wall and the rear wall, a bottom wall extending between and secured to bottom portions of the front wall, the rear wall, and the pair of side walls, and a top wall extending between top portions of the front wall, the rear wall, and the pair of side walls and secured to the top portion of at least one of the front wall, the rear wall, and the pair of side walls, wherein interior surfaces of the front wall, the rear wall, the pair of side walls, the bottom wall, and the top wall define the compartment therebetween, wherein the top wall is configured to function as a lid to selectively transition between an open configuration that provides access to the compartment and a closed configuration that entirely encloses the compartment;

a first insert configured to be received within the compartment and releasably secured in one of a plurality of fixed positions within the compartment such that the first insert extends between the interior surfaces of the front wall, the rear wall, and the pair of side walls and thereby separates the compartment into at least first and second subcompartments; and a track system, located within the compartment, and comprising at least first and second rails embedded within or fixed to opposing positions in the pair of side walls, the first and second rails each comprising a plurality of locking positions each associated with a pair of oppositely disposed recesses in the first and second rails, the first insert comprising locking members configured to extend from ends of the first insert and engage with the recesses to be secured in the one of the plurality of fixed positions corresponding to the plurality of locking positions, and a release mechanism configured to retract the locking members to disengage the recesses and thereby release the first insert from the one of the plurality of fixed positions.

16. The cooler of claim 15, wherein the first insert is configured to releasably engage the interior surfaces of the top wall to be secured thereto.

17. The cooler of claim 15, further comprising a second insert configured to be received within the compartment, while the first insert is secured in a first fixed position therein, and secured in a second fixed position within the compartment such that the second insert extends between the interior surfaces of the front wall, the rear wall, and the pair of side walls and thereby separates at least the second subcompartment into at least third and fourth subcompartments.

* * * * *